United States Patent [19]

Bouliane et al.

[11] Patent Number: 4,625,644

[45] Date of Patent: Dec. 2, 1986

[54] APPARATUS FOR AN OFFSET PRINTING PRESS

[76] Inventors: Mark H. Bouliane, P.O. Box 314; John D. Rohsner, Victoria, both of Navasota, Tex. 77868

[21] Appl. No.: 750,933

[22] Filed: Jul. 1, 1985

[51] Int. Cl.[4] ..... B41L 47/46

[52] U.S. Cl. ..... 101/426; 101/329; 101/352; 101/91

[58] Field of Search ..... 101/91, 426, 216–217, 101/329, 349, 352, DIG. 6, DIG. 22

[56] References Cited

U.S. PATENT DOCUMENTS

| | | | |
|---|---|---|---|
| 3,358,593 | 12/1967 | Ritzerfeld et al. | 101/91 |
| 3,618,513 | 11/1971 | Merker | 101/91 |
| 3,757,689 | 9/1973 | Koch et al. | 101/352 |
| 3,921,516 | 11/1975 | Toft et al. | 101/91 |
| 4,003,308 | 9/1977 | Decker | 101/329 |
| 4,008,663 | 2/1977 | Marshall et al. | 101/349 |
| 4,380,194 | 4/1983 | Carter et al. | 101/329 |
| 4,437,405 | 3/1984 | Haug | 101/349 |
| 4,466,347 | 8/1984 | Difflipf et al. | 101/DIG. 6 |
| 4,559,873 | 12/1985 | Godlewski | 101/329 |

*Primary Examiner*—E. H. Eickholt

*Attorney, Agent, or Firm*—Cahill, Sutton & Thomas

[57] ABSTRACT

An offset printing press includes a blanket cylinder defining a first cylindrical surface having a radius $r_1$ and a recessed section. A blanket is tightly stretched around the blanket cylinder and defines a second cylindrical surface having a radius $r_2$ greater than $r_1$. An impression cylinder is aligned with the blanket cylinder to define a printing interface between the blanket cylinder and the impression cylinder to receive paper sheets and to transfer an inked image from the blanket to the paper sheets. Drive means defines and maintains a fixed phase angle between the blanket cylinder and the immpression cylinder and rotates both cylinders at an equal angular velocity and in complementary directions to transfer images to the paper sheets. The number imprinting apparatus interfaces with the offset printing press and includes a number head having a body and a number imprinting surface. The body of the number head is retained within the recessed section of the blanket cylinder with the number imprinting surface aligned to contact the paper sheets as the number head is rotated through the printing interface. Synchronized inking means is located at a first angular position around the blanket cylinder and is angularly spaced apart from the printing interface. The synchronized inking means includes an ink transfer device, spacing means and displacing means. The spacing means maintains a gap between the ink transfer device and the blanket as the blanket is rotated past the ink transfer means. The displacing means periodically displaces the ink transfer device toward the blanket cylinder as the recessed section of the blanket cylinder is rotated past the ink transfer means. These periodic displacements of the ink transfer means cause the ink transfer means to contact the number head and transfer ink to the number imprinting surface of the number head.

17 Claims, 6 Drawing Figures

APPARATUS FOR AN OFFSET PRINTING PRESS

BACKGROUND OF THE INVENTION

1. Field of the Invention

This invention relates to number imprinting devices, and more particularly, to number imprinting devices forming a part of an offset printing press including a blanket cylinder and an impression cylinder.

2. Description of the Prior Art

In the printing business, offset printing presses are used to print multiple copies of tickets, invoices, multipart forms and various other documents. It is frequently desirable to sequentially number each separate document in a group of documents to specifically identify each otherwise identical duplicate document. Conventional offset printing press equipment has no capability for imprinting a sequential group of numbers onto a series of identical documents.

When a print shop owner is called upon to sequentially number a group of duplicate documents, a variety of different types of equipment may be utilized. One type of equipment is placed in series with the feed side or paper input side of the offset printing press and sequentially numbers each paper sheet before it is fed into the offset printing press and imprinted with the desired image. Other types of prior art numbering equipment operate on the delivery side of the offset printing press and sequentially number documents after they have been printed by the offset printing press. Other types of equipment which are unrelated to either the input or output stream of the offset printing press may be used to imprint numbers on a group of identical documents. Documents to be numbered are fed one at a time into such equipment which is then manually actuated by a foot switch or related device. Such one at a time, manually fed numbering operations are slow, time consuming and costly to the customer. The registration characteristics of such equipment is comparatively poor in that the position of the numbers imprinted on each documents typically vary by a significant distance since the equipment is unable to position each document into a fixed location on a repeatable basis.

In the past, one organization manufactured an offset printing press which could be converted back and forth between an image printing device and a numbering device. In order to accomplish this conversion, the blanket was physically removed from the blanket cylinder, a number head was secured within the recessed section of the blanket cylinder, and a cylindrical metal ink roller was firmly clamped into a fixed position in proximity to the number imprinting surface of the number head to reink the number head after each revolution of the blanket cylinder. When number operations had been completed, the number head and inking roller assembly was removed from the printing press and the blanket was reinstalled on the printing press. A second cylindrical roller was secured adjacent to the ink roller to distribute printer's ink onto the surface of the ink roller. Approximately thirty minutes was required to either remove the blanket and install the numbering device or to reconvert the unit to a printing press by removing the numbering and inking mechanism and reinstalling the blanket. The total numbering system installation and removal process required one hour. Use of this numbering system required removal of the blanket since otherwise the ink roller would ink both the number head and the entire blanket and cover the entire image receiving surface of each document with ink. This attachment for converting an offset printing press into a number imprinting device was never commercially accepted as a result of the extensive time and effort required to convert the device between an offset printing press and a number imprinting device, resulting in substantial, costly press down time.

SUMMARY OF THE INVENTION

It is therefore a primary object of the present invention to provide a number imprinting apparatus which can be directly retrofitted to a wide variety of existing commercially available offset printing press equipment for enabling the offset printing press to be converted in less than thirty seconds to operate as either a number imprinting apparatus or as an offset printing press.

Another object of the present invention is to provide a number imprinting apparatus forming a part of an offset printing press which ensures precise, highly repeatable registration of the imprinted numbers on a plurality of documents sequentially fed through the printing press.

Yet another object of the present invention is to provide a number imprinting apparatus forming a part of an offset printing press which can adjust the vertical location where a number is imprinted on a document by utilizing an existing offset printing press cylinder timing adjustment mechanism.

Still another object of the present invention is to provide a number imprinting apparatus for an offset printing press which can simultaneously imprint one, two, three, four or more series of sequentially advanced numbers at different locations on each document of a group of documents sequentially fed through the printing press.

Yet another object of the present invention is to provide a number imprinting apparatus for an offset printing press which can crash number underlying documents in a multipart form to thereby ensure that the outer page and each underlying page of the multi-part form is imprinted with the same number at the same location on each sheet forming an element of the multipart form.

Still another object of the present invention is to provide a number imprinting apparatus for an offset printing press which will reink the number imprinting surface of a number head once per blanket cylinder revolution without either contacting the surface of the blanket or disturbing an inked image residing on the outer surface of the blanket.

Yet another object of the present invention is to provide a number imprinting apparatus for an offset printing press which can be used without removing, adjusting or otherwise operating on the blanket which surrounds the blanket cylinder of the printing press.

Briefly stated, and in accord with one embodiment of the invention, a number imprinting apparatus is adapted for use in connection with an offset printing press. The offset printing press includes a blanket cylinder which defines a first cylindrical surface having a radius $r_1$ and a recessed section. A blanket is tightly stretched around the blanket cylinder and defines a second cylindrical surface which includes a radius $r_2$ greater than $r_1$. An impression cylinder is aligned with the blanket cylinder to define a printing interface between the blanket cylinder and the impression cylinder for receiving paper sheets one at a time and transferring an inked image from the blanket to image surface of each paper sheet. Drive means defines and maintains a fixed phase angle between the blanket cylinder and the impression cylinder and rotates both cylinders at an equal angular velocity and in complementary directions to transfer images to the paper sheets. The number imprinting apparatus comprises a number head having a body and a number imprinting surface. Means is provided for retaining the body of the number head within the recessed section of the blanket cylinder with the number imprinting surface aligned to contact each paper sheet as the number head is rotated through the printing interface. Synchronized inking means is located at a first angular position around the blanket cylinder and is angularly spaced apart from the printing interface. The synchronized inking means includes ink transfer means, spacing means and displacing means. The spacing means maintains a gap between the ink transfer means as the blanket is rotated past the ink transfer means. The displacing means periodically displaces the ink transfer means toward the blanket cylinder as the recessed section of the blanket cylinder is rotated past the ink transfer means. The displacing means thereby causes the ink transfer means to contact the number head and to transfer ink to the number imprinting surface of the number head. The present invention operates to periodically reink the number imprinting surface of the number head as the recessed section of the blanket cylinder is rotated past the synchronized inking means without causing the ink to be transferred from the synchronized inking means to the blanket.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
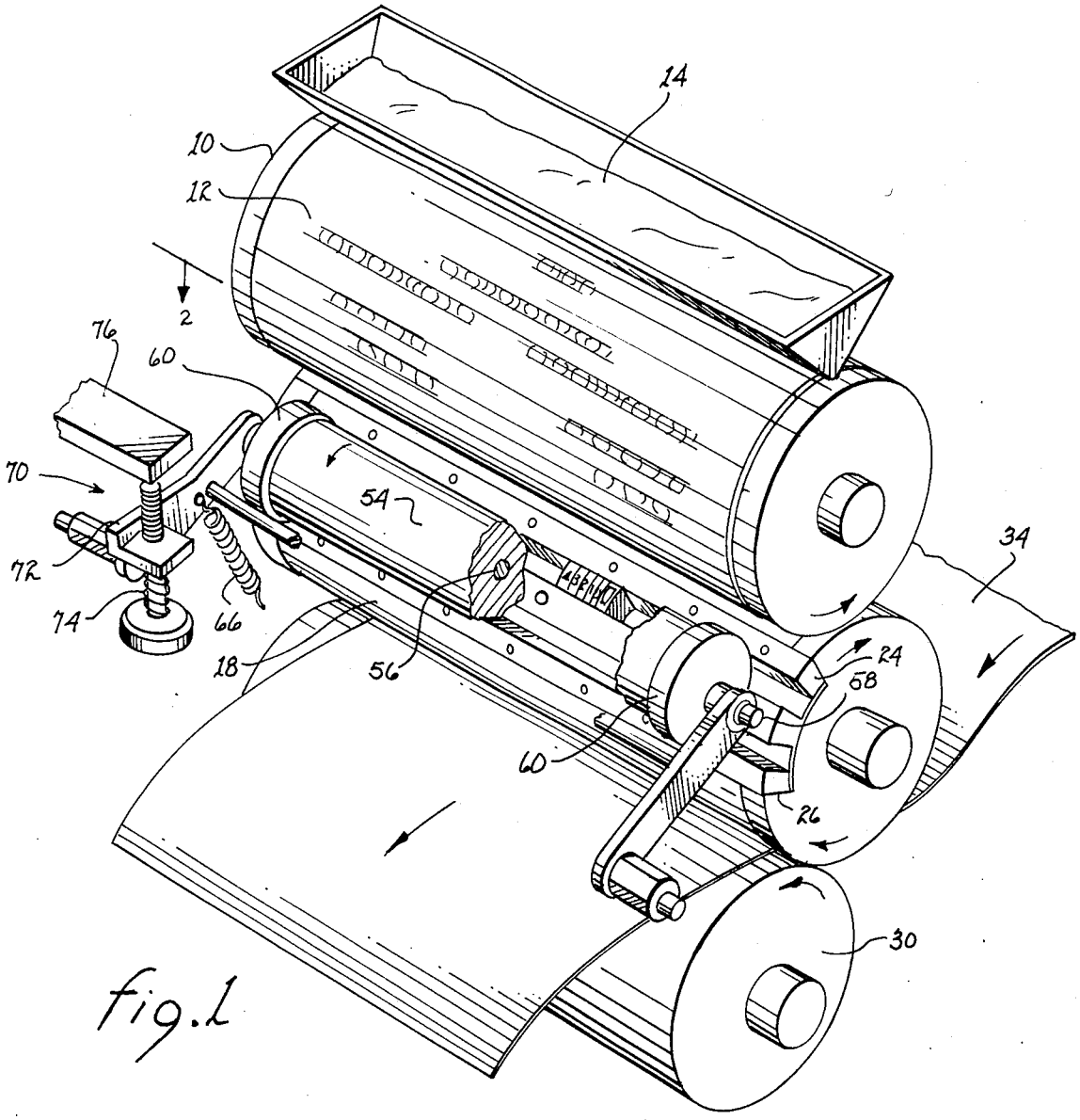
FIG. 1 is a perspective view of an offset printing press incorporating the number imprinting apparatus of the present invention.
Figure 3A:
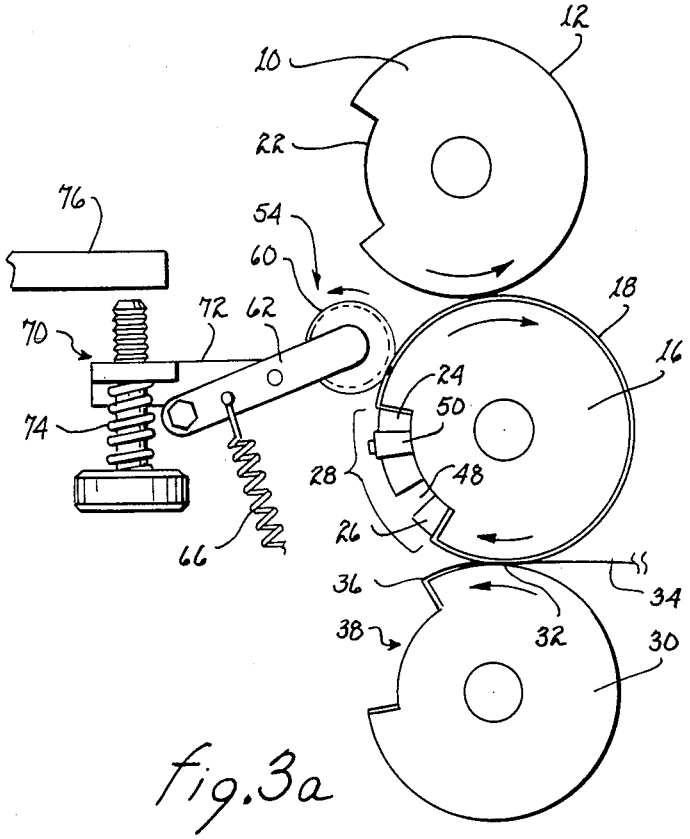
FIG. 3*a* is a partially cutaway elevational view view of the number imprinting apparatus of the present invention depicting the gap of the blanket cylinder and the gap of the impression cylinder with the timing adjusted to avoid numbering operations.

FIGS. 1 and 3*a* illustrate that a conventional offset printing press includes a plate cylinder 10 to which a cylindrical inked master 12 is attached. Ink is supplied to inked master 12 from an ink dispenser 14. A cylindrical blanket cylinder 16 is aligned parallel with plate cylinder 10. The inked image from plate cylinder 10 is transferred to a rubber-like blanket 18 along an image transfer interface designated by reference number 20. Inked master 12 is mechanically coupled to plate cylinder 10 by hardware (not shown) positioned within a recessed section or gap designated by reference number 22. In a similar manner, blanket 18 is mechanically secured to blanket cylinder 16 by blanket bars 24 and 26 which are positioned within a recessed section or gap in blanket cylinder 16 designated by reference number 28. In standard commercially available offset printing presses, blanket bars 24 and 26 are the only elements positioned within gap 28.

A cylindrical impression cylinder 30 is aligned with blanket cylinder 16 and defines a printing interface 32 where the inked image on blanket cylinder 18 is transferred to paper sheets 34 which are sequentially fed through the printing press from the feed side (right side of drawings) to the delivery side (left side of drawings). A mechanical gripper 36 is positioned within a recessed section or gap 38 in the surface of impression cylinder 30. Gripper 36 is periodically displaced upward to receive the leading edge of each paper sheet 34 on the feed side of the printing press. Subsequent rotation of impression cylinder 30 causes gripper 36 to be downwardly displaced and to thereby tightly engage the leading edge of each paper sheet 34. Gripper 36 maintains a precise alignment or registration of each paper sheet 34 with respect to blanket cylinder 16 and impression cylinder 30. After a complete image has been transferred from blanket 18 to the image receiving surface of paper sheet 34, gripper 36 is displaced outward to release its mechanical grip on paper sheet 34.

By retrofitting the various elements of the present invention to an existing offset printing press, the printing press is capable of sequentially numbering a series of paper sheets 34 as well as transferring images to the image receiving side of these paper sheets. The image transfer process is normally accomplished first after which the same series of paper sheets is fed through the printing press a second time to sequentially number each sheet. In describing the preferred embodiment of the present invention, the mechanical elements of the invention which are added to the blanket cylinder will initially be described, followed by the detailed description of the synchronized inking means which is positioned outboard of blanket cylinder 16.

Referring now to FIGS. 1, 3*a*, 4 and 5, the mechanical elements of the present invention which are positioned within gap 28 of the blanket 16 will now be described in detail. A cradle 40 is fabricated from a rigid metal or equivalent material which can be precisely machined to exact mechanical tolerances. Cradle 40 is dimensioned to fit within gap 28 of blanket cylinder 16 as shown. A plurality of securing means such as bolts 42 are disposed through the central section of cradle 40 and are mechanically secured to threaded apertures in the body of blanket cylinder 16 within gap 28. Blanket bars 24 and 26 are positioned within gap 28 in abutting contact with the base of cradle 40 and serve to mechanically secure blanket 18 to blanket cylinder 16.

Figure 5:
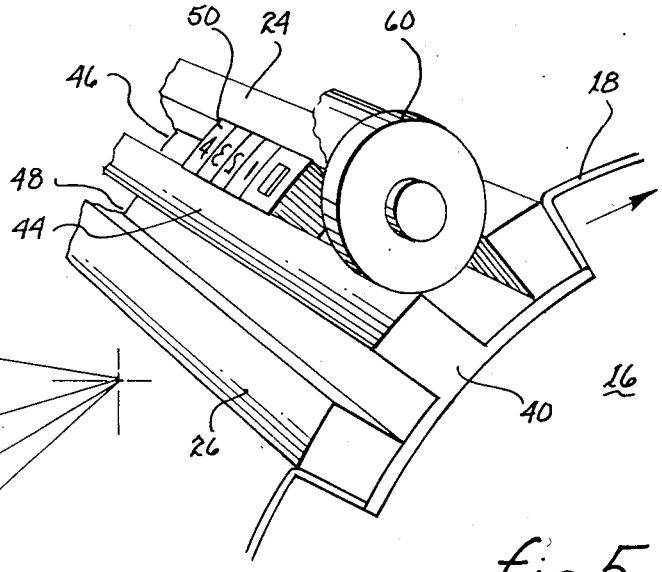
FIG. 5 is a partially cutaway enlarged perspective view particularly illustrating the spacial relationship of the number head, blanket bars and the cradle.

Cradle 40 includes a raised central section or wedge 44. The spacing between the vertically oriented side surfaces of wedge 44 and the vertically oriented side surfaces of blanket bars 24 and 26 defines a pair of open rectangular channels 46 and 48 as best illustrated in FIG. 5 which are dimensioned to receive from as few as one to as many as four number heads 50. In implementing the present invention, standard type high number heads include a rectangular steel body which is mechanically wedged into and retained by channels 46 and 48. These number heads include a number imprinting surface 52 and vertically displaceable number indexer which incrementally advances the number count after each pass of the number head through printing interface 32.

Figure 4:
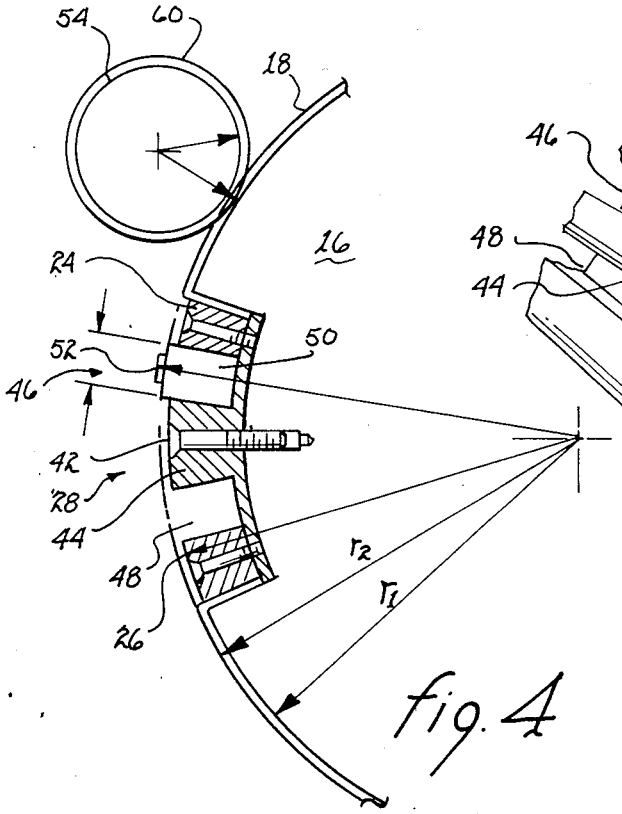
FIG. 4 is a partially cutaway enlarged elevational view illustrating the ink roller, the elements positioned within the gap of the blanket cylinder, and the relative interrelationship between those elements.

In FIG. 4, radius $r_1$ designates the radius of blanket cylinder 16 while radius $r_2$ designates the radius of the outer surface of blanket 18. Shims are placed between the lower surface of number head 50 and the upper surface of the base of cradle 40 to align number imprinting surface 52 at a level approximately 0.005 to 0.10 inches above the outer surface of blanket 18 as designated by reference number 53 in FIG. 2. It would be obvious to a person of ordinary skill in the art that various other positional relationships of number imprinting surface 52 with respect to the surface of blanket 18 would be possible and still cause the number imprinting apparatus to operate in an acceptable manner.

FIG. 5 indicates that number head 50 can be located at any lateral position along the length of channel 46. The specific lateral position of number head 50 is typically dictated by the configuration of the printed image of paper sheet 34 and by the position in which the sequential series of numbers is desired to be imprinted. When a user of the number imprinting apparatus of the present invention desires to imprint more than a single series of numbers on each paper sheet 34, an additional number head 50 may be positioned in channel 46 and an additional one or two number heads may be positioned in channel 48. It would be readily apparant that numerous other configurations of number head 50 could be implemented in practicing the present invention.

The synchronized inking means represents the second major element of the present invention and reinks the number imprinting surface 52 of number head 50 following each pass of number head 50 through printing interface 32. It is important to the operation of the present invention that the synchronized inking means transfers ink only to the number imprinting surface 52 of the number head 50 while totally avoiding contact with the image carrying surface of blanket 18 as blanket cylinder 16 continuously rotates. The synchronized inking means will now be described by referring to FIGS. 1–5.

The synchronized inking means includes ink transfer means in the form of a cylindrical ink roller 54, spacing means which maintains a gap between the ink transfer means and blanket 18 as the blanket is rotated past the ink roller, and means for periodically displacing the ink transfer means toward and away from blanket cylinder 16 as the recessed section or gap 28 of blanket cylinder 16 is rotated past the ink transfer means. This unique operation of the synchronized inking means of the present invention causes the ink transfer means to periodically contact the number imprinting surface 52 of the number head 50.

Figure 2:
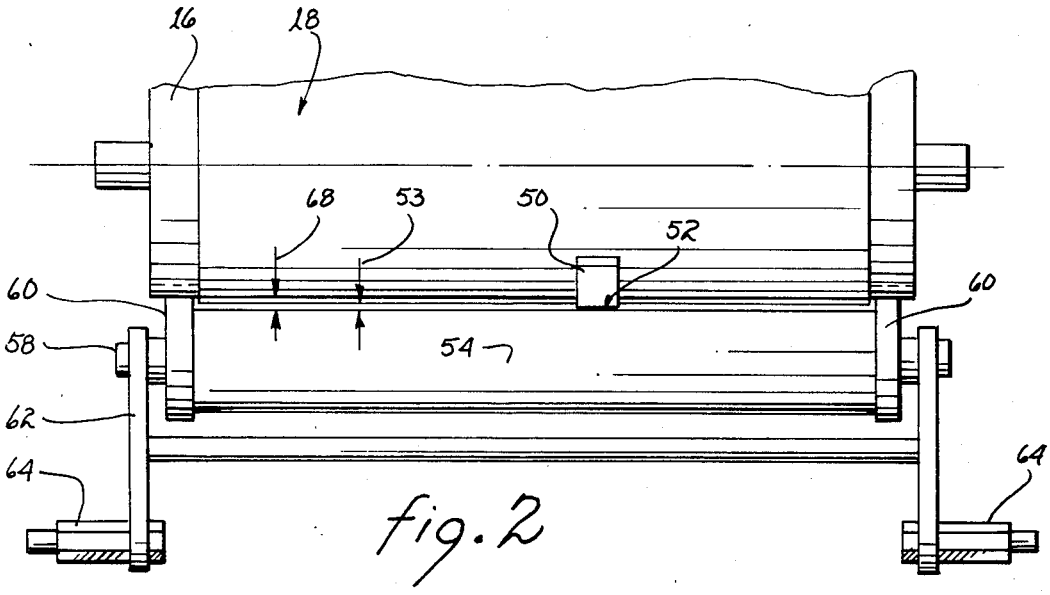
FIG. 2 is a partially cutaway view from above of the blanket cylinder and synchronized inking means of the present invention depicted in FIG. 1, taken along section line 2—2.

In the preferred embodiment of the present invention, ink roller 54 assumes a cylindrical configuration and includes a phenolic core having a cylindrical passageway 56 which is dimensioned to receive a cylindrical support shaft 58. Ink roller 54 utilizes a cylindrical, porous, preinked roller for supplying ink at the surface of ink roller 54 on a continuous basis. Such preinked rollers are commercially available and are frequently used on adding machine and cash register products. In the preferred embodiment of the invention, the outer diameter of ink roller 54 is equal to 1.5 inches; the overall width is equal to 10.5 inches; and the width of the inked surface equals 10.25 inches. A pair of 1.75 inch diameter urethane rollers 60 are coupled to the outer ends of ink roller support shaft 50. As best illustrated in FIG. 2, rollers 60 directly engage the outer surface of blanket cylinder 16 just beyond the outer edge of blanket 18. In other embodiments of the invention where blanket 18 extends to the outer edge of blanket cylinder 16, rollers 60 may be configured to ride directly on the outer edge of blanket 18.

A bracket 62 is coupled by bearing surfaces to the outer ends of ink roller support shaft 58 as specifically illustrated in FIG. 2. The opposite ends of bracket 62 include pivotal coupling means 64 which engage either preexisting or specially drilled recesses in the frame of the offset printing press to which the number imprinting apparatus of the present invention is attached.

In most installations, it has been found desirable to attach biasing means in the form of a spring 66 between pivotal coupling means 64 and ink roller 54 to maintain a firm contact between roller 60 and blanket cylinder 16 and to minimize bouncing caused by the rotation of blanket cylinder 16 with respect to ink roller 54 and the periodic transitions of rollers 60 between blanket cylinder 16 and gap 28. The opposite end of spring 66 is coupled to the existing structure of the offset printing press FIG. 2 depicts the relative spacing between the outer surface of ink roller 54, the number imprinting surface 52 of number head 50, the surface of blanket 18, and the outer surface of blanket cylinder 16. The dimensional differential between ink roller 54 and rollers 60 maintains a spacing on the order of 0.25 inches between the surface of ink roller 54 and the surface of blanket cylinder 16 as illustated by the arrows identified by reference number 68.

FIG. 3*a* illustrates an offset printing press to which the number imprinting apparatus of the present invention has been attached. With the relative phase relationship between blanket cylinder 16 and impression cylinder 30 as depicted in FIG. 3*a*, the number imprinting apparatus is deactivated since the gap 28 in blanket cylinder 16 is precisely aligned or in phase with the gap 38 in impression cylinder 30. The angular alignment of gap 28 with gap 38 causes gripper 36 to engage the leading edge of each paper sheet 34 after number head 50 has been rotated past the leading edge of sheet 34. When number head 50 transitions through printing interface 32, it is aligned with gap 38 and does not engage an opposing surface capable of providing a firm surface for the number imprinting surface 52 of number head 50 to crash against and thereby transfer a numbered image. Blanket cylinder 16 and impression cylinder 30 are therefore normally maintained with the timing relationship depicted in FIG. 3*a* when the printing press is utilized solely for printing operations and not for numbering operations.

Figure 3B:
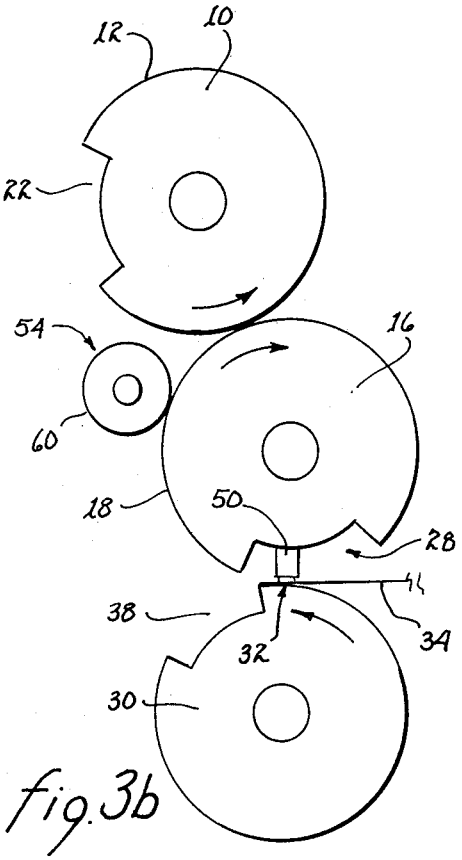
FIG. 3*b* depicts the timing between the blanket cylinder and the impression cylinder adjusted so that the number head contacts and numbers paper sheets.

When the offset printing press to which the number imprinting apparatus of the present invention has been attached is used for number imprinting operations, the relative phase angle between blanket cylinder 15 and impression cylinder 30 is changed into a configuration of the type depicted in FIG. 3*b*. This relative phase angle between blanket cylinder 16 and impression cylinder 30 may be easily changed by readjusting the timing gear which transfers rotational motion between blanket cylinder 16 and impression cylinder 30. A timing adjustment mechanism is provided as a standard item of equipment on virtually all commercially available direct feed offset printing presses. With the modified timing or phase relationship between blanket cylinder 16 and impression cylinder 30 as depicted in FIG. 3*b*, gripper 36 engages the leading edge of paper sheet 34 and rotates it through printing interface 32. The number imprinting surface 52 of number head 50 is then subsequently rotated through the printing interface and transfers a sequentially numbered image to the image receiving surface of sheet 34. The relative timing relationship between blanket cylinder 16 and impression cylinder 30 determines the vertical alignment of the numbered image on paper sheet 34. Increasing the timing differential moves the number image down the vertical dimension of sheet 34.

Although blanket 18 is kept in place on blanket cylinder 16 during all numbering operations, the offset printing press may be adjusted so that plate cylinder 10 ceases to transmit inked images from inked master 12 to blanket cylinder 18. The image receiving surface of paper sheet 34 in this configuration is imprinted with a number from number head 50 without receiving an image from blanket 18.

Although the number imprinting apparatus is typically actuated to number a series of paper sheets 34 during a second pass after a first pass when an image is transferred to sheet 34, the inherent operation of gripper 36 maintains extremely precise registration between impression cylinder 30 and the leading edge of each paper sheet 34 so that a registration on the order of one hundreth of an inch or less can be maintained during the second pass of sheets 34 through the printing press. Precise registrations of this nature is a highly desirable advantage of the number imprinting apparatus of the present invention, particularly in connection with numbering operations on small media such as tickets.

As best illustrated in FIG. 5, clockwise rotation of blanket cylinder 16 causes rollers 60 to transition from the surface of blanket cylinder 16 onto the upper surface of blanket bars 24 and 26 and the upper surface of wedge 44 of cradle 40. As rollers 60 pass across the open, non-load bearing surfaces of channels 46 and 48, rollers 60 drop down into these channels a distance on the order of ⅛th of an inch. The radial displacement of rollers 60 is limited by adjustable stop means 70 as illustrated in FIGS. 1 and 3*a*. This adjustable stop means includes a bracket element 72 which extends outward from the body of bracket 62 as illustrated in FIGS. 1 and 3*a* and includes a threaded screw 74 the end of which is adjusted to provide a predetermined spacing with respect to a bar 76 which forms a part of the structure of the offset printing press. Downward displacement of rollers 60 toward the center of blanket cylinder 16 pivots the end of screw 74 toward bar 76. Adjustable stop 70 is adjusted to limit the downward displacement of rollers 60 with respect to blanket cylinder 16 to thereby limit the displacement of the surface of ink roller 54 toward the number imprinting surface of ink roller 54.

To minimize wear on the structure of the number imprinting apparatus when the number imprinting function of the present invention is not required, screw 74 of adjustable stop means 70 is adjusted to engage bar 76 and to lift rollers 60 away from the surface of blanket cylinder 16. In this non-functional configuration, rollers 60 cease rotation and wear on the synchronized inking means of the number imprinting apparatus is eliminated.

The firm contact between rollers 60 and the surface of blanket cylinder 16 during normal numbering operations, equalizes the angular surface velocity of ink roller 54 with the angular surface velocity of the number imprinting surface 52 of number head 50. This equalized angular velocity between the ink supplying and ink receiving elements of the number imprinting apparatus ensures a smooth, low friction contact between these surfaces and optimum transfer of ink from ink roller 54 to the number imprinting surface 54 of number head 50. In addition, the lack of a differential velocity between these two rotating elements prevents inadvertent sequencing of number head 50 by ink roller 54.

When the number imprinting apparatus of the present invention is used on standard offset printing presses operating at a velocity of six thousand inches per hour, rollers 60 may be manufactured from urethane having a hardness of approximately seventy durometers. For printing presses which operate at higher rotational velocities, rollers 60 should be manufactured from a harder urethane or equivalent product such as ninety durometer urethane. This harder roller material prevents the surface of ink roller 54 from contacting the leading edge of blanket 18 as rollers 60 transition out of gap 28 onto the leading edge of blanket 18.

It will be apparent to those skilled in the art that the disclosed number imprinting apparatus for an offset printing press may be modified in numerous ways and may assume many embodiments other than the preferred form specifically set out and described above. For example, the ink transfer means of the present invention may assume the form of a solenoid actuated inking device. This device would maintain a fixed spacing between the inking surface and blanket 18 until number head 50 was rotated into a position from which the solenoid could be actuated to cause the inking surface to contact the number imprinting surface 52 of number head 50. A system of this type would require means for measuring the rotational position of blanket cylinder 16 with respect to the ink transfer means. A variety of electronic components and systems are available to measure the rotational position of number head 50 with respect to the ink transfer means of the present invention and to actuate the solenoid or other periodic displacement means to cause the ink surface to contact the number head at the appropriate time and position. The key concept behind the present invention is that of maintaining spacing between the inking surface and blanket 18 until a number head within gap 28 of blanket cylinder 16 is rotated to a position adjacent to an inking surface. At that time, the inking surface is made to contact the number head to transfer ink from one element to another. In this manner, the offset printing press can maintain normal operations at all times without requiring removal of blanket 18 from blanket cylinder 16 in order to render the system capable of sequentially numbering the paper sheets 34. In a matter of seconds, an offset printing press including the number imprinting apparatus of the present invention can be retimed or rephased to transition between normal printing operations and numbering operations.

Since in practicing the present invention the blanket cylinder remains on the press at all times, an inked master plate 12 can be installed on plate cylinder 10 to simultaneously accomplish numbering and printing operations on paper sheets as they are fed through the press. During such operations, blanket 18 is inked by the existing press inking mechanism. The blanket cylinder to impression cylinder timing is adjusted such that the printed image commences approximately 1.33 inches below the bottom of each number. In this configuration, the press simultaneously crash numbers and offset prints using a single blanket cylinder for both operations.

What is claimed is:

1. In an offset printing press including i. a blanket cylinder defining a first cylindrical surface having a radius $r_1$ and a recessed section;

ii. a blanket tightly stretched around said blanket cylinder and defining a second cylindrical surface having a radius $r_2$ greater than $r_1$;

iii. an impression cylinder aligned with said blanket cylinder to define a printing interface between said blanket cylinder and said impression cylinder for receiving paper sheets and transferring an inked image from said blanket to the paper sheets; and iv. adjustable drive means for defining and maintaining a fixed phase angle between said blanket cylinder and said impression cylinder and for rotating said cylinders at an equal angular velocity and in complementary directions to transfer images to the paper sheets;

a number imprinting apparatus comprising:

a. a number head having a body and a number imprinting surface;

b. means for retaining the body of said number head within the recessed section of said blanket cylinder with the number imprinting surface aligned to contact the paper sheets as said number head is rotated through the printing interface;

c. synchronized inking means located at a first angular position around said blanket cylinder angularly spaced apart from the printing interface, said synchronized inking means including i. ink transfer means;

ii. spacing means for maintaining a gap between said ink transfer means and said blanket as said blanket is rotated past said ink transfer means; and iii. means for periodically displacing said ink transfer means toward and away from said blanket cylinder as said recessed section is rotated past said ink transfer means to cause said ink transfer means to contact said number head and transfer ink to the number imprinting surface of said number head;

whereby the number imprinting surface of said number head is periodically reinked as the recessed section of said blanket cylinder is rotated past said synchronized inking means without transferring ink from said synchronized inking means to said blanket.

2. The number imprinting apparatus of claim 1 further including stop means for limiting the maximum displacement of said ink transfer means toward said blanket cylinder.

3. The number imprinting apparatus of claim 1 including means for deactivating said synchronized inking means.

4. The number imprinting apparatus of claim 3 wherein said deactiviating means includes means for deactivating said ink transfer means displacing means.

5. The number imprinting apparatus of claim 1 wherein said ink transfer means includes:

a. a cylindrical ink roller;

b. a bracket for maintaining the axis of said ink roller aligned with the axis of said blanket cylinder wherein said bracket is pivotally coupled to an immovable part of said printing press.

6. The number imprinting apparatus of claim 5 wherein said bracket maintains the surface of said cylindrical ink roller parallel to and in close proximity to said blanket as said blanket cylinder is rotated with respect to said bracket.

7. The number imprinting apparatus of claim 6 wherein said spacing means includes first and second wheels coaxially aligned with and positioned outboard of said cylindrical ink roller for engaging the spaced apart edges of the surface of said blanket cylinder and for maintaining the gap between the surface of said ink roller and said blanket.

8. The number imprinting apparatus of claim 7 wherein said first and second wheels are coupled to rotate said ink roller whereby the surface of said ink roller is rotated at a velocity substantially equal to the rotational velocity of the surface of said blanket cylinder.

9. The number imprinting apparatus of claim 7 wherein said recessed section includes first and second parallel end surfaces oriented perpendicular to the ends of said blanket cylinder and wherein said number head retaining means includes first and second bars oriented perpendicular to and extending between the ends of said blanket cylinder for engaging the body of said number head.

10. The number imprinting apparatus of claim 9 wherein the gap between said bars of said number head retaining means define a channel and wherein the transition of said first and second wheels into said channel causes the surface of said ink roller to be displaced toward said blanket cylinder and contact the number imprinting surface of said number head.

11. The number imprinting apparatus of claim 1 wherein adjustments of said drive means to vary the phase angle between said blanket cylinder and said impression cylinder changes the location along the vertical axis of each paper sheet at which the number imprinting surface of said number head contacts said paper sheet.

12. The number imprinting apparatus of claim 5 wherein said spacing means further includes biasing means for urging said bracket toward the blanket cylinder.

13. The number imprinting apparatus of claim 12 wherein said biasing means includes a spring.

14. In an offset printing press including i. a blanket cylinder defining a first cylindrical surface having a radius $r_1$ and a recessed section;

ii. a blanket tightly stretched around said blanket cylinder and defining a second cylindrical surface having a radius $r_2$ less than $r_1$;

iii. an impression cylinder aligned with said blanket cylinder to define a printing interface between said blanket cylinder and said impression cylinder for receiving paper sheets and transferring an inked image from said blanket to the paper sheets; and iv. adjustable drive means for defining and maintaining a fixed phase angle between said blanket cylinder and said impression cylinder and for rotating said cylinders at an equal angular velocity and in complementary directions to transfer images to the paper sheets;

a method for imprinting numbers on paper sheets comprising the steps of a. positioning a number head having a body and a number imprinting surface within the recessed section of said blanket cylinder with the number imprinting surface aligned to contact the paper sheets as said number head is rotated through the printing interface;

b. providing ink transfer means at a first angular position around said blanket cylinder at a location angularly spaced apart from the printing interface;

c. maintaining a gap between said ink transfer means and said blanket as said blanket is rotated past said ink transfer means; and d. periodically displacing said ink transfer means toward and away from said blanket cylinder as said recessed section is rotated past said ink transfer means to cause said ink transfer means to contact said number head and transfer ink to the number imprinting surface of said number head; and e. impressing the number imprinting surface of said number head against each paper sheet as it passes through the printing interface to transfer an inked, number generating image from said number imprinting surface to each paper sheet;

whereby the number imprinting surface of said number head is periodically reinked as the recessed section of said blanket cylinder is rotated past said ink transfer means without transferring ink from said ink transfer means to said blanket.

15. The method of claim 14 wherein said impression cylinder includes a recessed section and wherein said method comprises the further step of adjusting the relative phase angle between said blanket cylinder and said impression cylinder such that said number head passes through the printing interface at a time different from the time when the recessed section of said impression cylinder passes through the printing interface.

16. The method of claim 14 including the further step of maintaining said ink transfer means spaced apart from the number imprinting surface of said number head to terminate the transfer of ink from said ink transfer means to the number imprinting surface of said number head.

17. The method of claim 15 wherein said press further includes a plate cylinder having an inked master aligned to transfer an inked image from said inked master to said blanket and wherein said method includes the further step of transferring an inked image from said inked master to said blanket and then to each paper sheet, whereby said press simultaneously prints an image on and sequentially numbers each of a plurality of paper sheets fed through said press.

* * * * *